United States Patent [19]

Denson

[11] 4,122,737

[45] Oct. 31, 1978

[54] FOOD STUFFS HOLDER AND CUTTER ASSEMBLY

[76] Inventor: Richard E. Denson, 704 Perry St., Scottsborough, Ala. 35768

[21] Appl. No.: 807,446

[22] Filed: Jun. 17, 1977

[51] Int. Cl.[2] ..... B26D 7/16

[52] U.S. Cl. ..... 83/268; 83/396; 83/467 A; 83/391

[58] Field of Search ..... 83/396, 467 A, 467, 83/394, 419, 703, 707, 247, 257, 262, 268, 391

[56] References Cited

U.S. PATENT DOCUMENTS

| | | | |
|---|---|---|---|
| 39,298 | 7/1863 | March | 83/268 |
| 78,149 | 5/1868 | Stackhouse | 83/419 |
| 1,735,818 | 11/1928 | Ulbrecht | 83/268 |

*Primary Examiner*—Donald R. Schran
*Attorney, Agent, or Firm*—C. A. Phillips

[57] ABSTRACT

A holder and cutter assembly for food stuffs in stick form, the assembly comprising a chamber for receiving a food stuff in stick form, a carrier disposed in the chamber and adapted to move lengthwise of the chamber in abutting relationship with the food stuff, means for biasing the carrier toward an opening in the chamber, stop means outside the opening to permit a portion of the food stuff stick to be exposed outside the chamber in response to the biasing means, and cutter means disposed adjacent the opening and operable to cuttingly engage the exposed portion of the food stuff stick to sever the exposed portion from the remainder of the food stuff stick, the stop means being adapted to release the severed portion.

5 Claims, 3 Drawing Figures

FOOD STUFFS HOLDER AND CUTTER ASSEMBLY

BACKGROUND OF THE INVENTION

1. Field of the Invention

This invention relates to a dispenser for food stuffs and is directed more particularly to a holder and cutter assembly for food stuffs in stick form.

2. Description of the Prior Art

It is often desirable, and more sanitary, to serve certain food stuffs normally appearing in stick form, such as butter or cheese, in individual servings or "pats." Serving pats of such food stuffs at the dinner table obviates the sometimes unpleasantness of having unclean knives used to sever portions of butter or cheese from their respective stick form servings.

In other instances, it is desirable to serve foods such as prepared meats, in slices of equal width, for esthetic as well as sanitary purposes.

While devices intended to accomplish these results have been designed, they are by and large too complex and expensive for the ordinary kitchen or dinner table.

SUMMARY OF THE INVENTION

It is, therefore, an object of the present invention to provide a food stuffs holder and cutter assembly for holding and cutting into individual slices food stuffs normally appearing in stick form, such as butter, cheese, prepared meats, and the like.

Another object of the invention is to provide such a device as is economical to manufacture and easy to use.

With the above and other objects in view, as will hereinafter appear, a feature of the present invention is the provision of a holder and cutter assembly for food stuffs in stick form, the assembly comprising a chamber for receiving a food stuff in stick form, a carrier disposed in the chamber and adapted to move lengthwise of the chamber in abutting relationship with the food stuff, means for biasing the carrier toward an opening in the chamber, stop means disposed outside the chamber proximate to the opening and in alignment with the chamber, the stop means being adapted to permit a portion of the food stuff stick to be exposed outside the chamber in response to the biasing means, and cutter means disposed adjacent the opening and operable to cuttingly engage the exposed portion of the food stuff stick to sever the exposed portion from the remainder of the food stuff stick, the stop means adapted to release the severed portion.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 1:
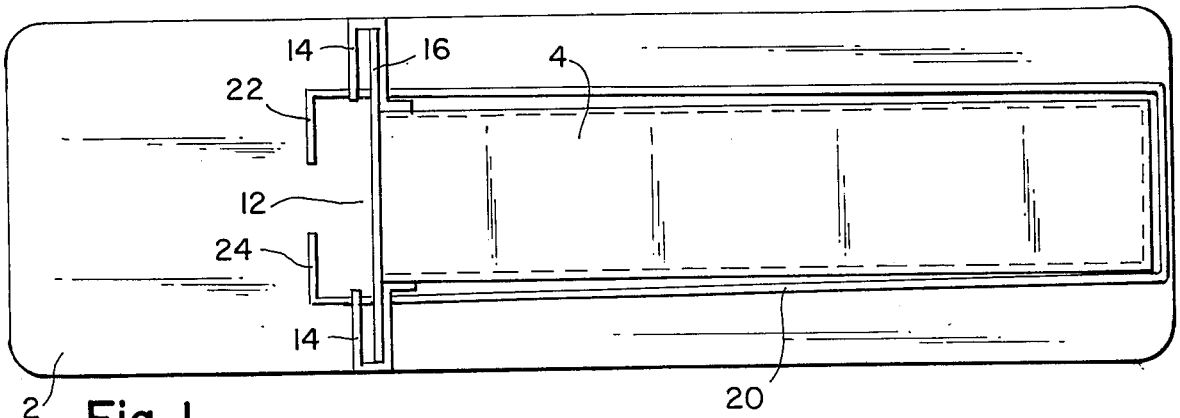
FIG. 1 is a plan view of one form of holder and cutter assembly illustrative of an embodiment of the invention.
Figure 2:
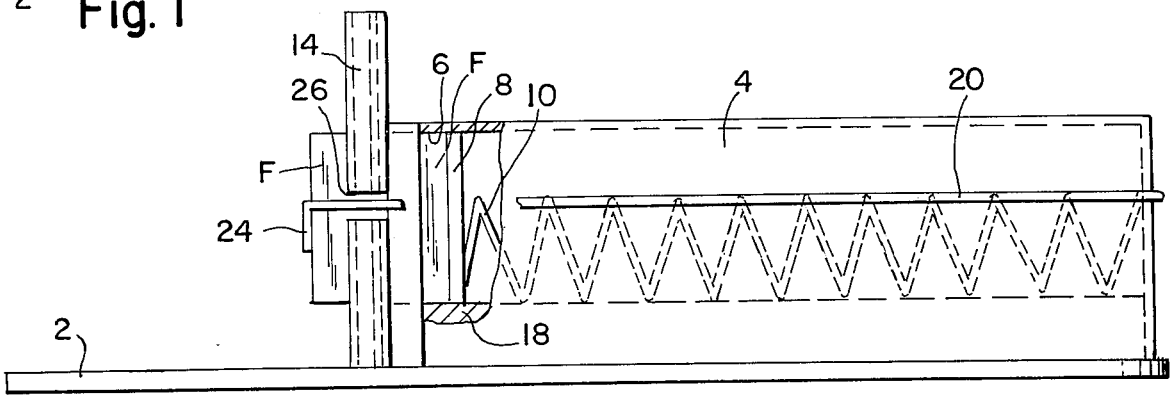
FIG. 2 is a side elevational view, partly cut away, of the assembly shown in FIG. 1.

Referring to FIGS. 1 and 2, it will be seen that the illustrative assembly includes a base member 2 on which is disposed a housing 4 having a chamber 6 therein. Within the housing chamber 6 there is disposed a carrier 8 biased to the left, as shown in FIG. 2, by a spring means 10.

The housing 4 is provided with an opening 12 having at either side thereof a bracket member 14 which slidingly receives a door and knife member 16. The chamber 6 is also provided with a support member 18 on which is disposed a food stuff stick F.

Figure 3:
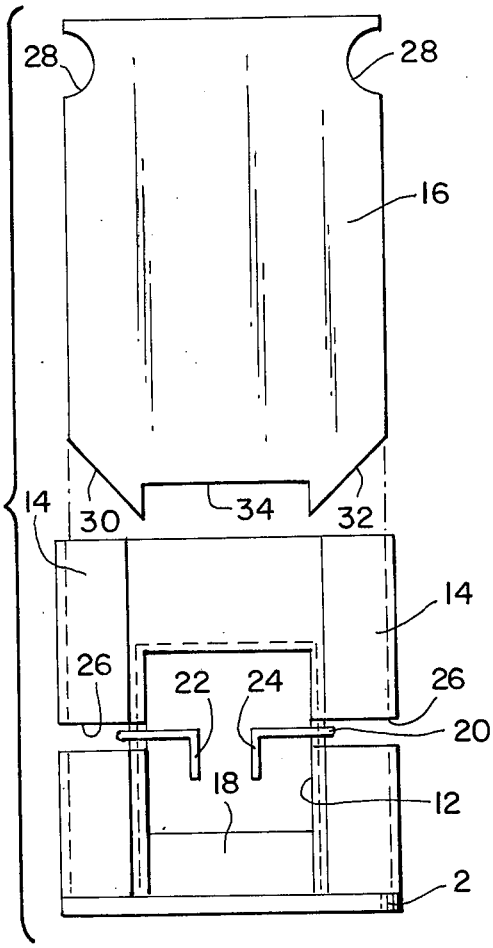
FIG. 3 is a partial end view of the device shown in FIG. 1 in combination with an elevational view of the door and cutter portion of the assembly.

The device is provided with stop means, which in the embodiment shown comprise a wire like spring 20 having first and second arm portions 22, 24. As best seen in FIG. 3, the arm portions 22, 24 of the spring member 20 extend across the path defined by the chamber 6 and the opening 12, but are removed from the opening 12, as seen in FIG. 1. The bracket members 14 are provided with slot means 26 which receive the spring means 20. It will be apparent that the distance of the arms 22, 24 of the spring means 20 from the opening determines the width of each slice of the product. The door and knife member 16 is provided with grip means 28 to facilitate the manual operation of the member 16. In addition, the member 16 is provided adjacent its cutting edge with first and second cam means 30, 32 which are engageable with the spring means 20 to urge the arm portions 22, 24 away from each other and into an out of the way position.

In operation, a stick of butter, cheese, meat, or the like, is inserted in the housing chamber 6 by way of the opening 12 against the pressure of the spring means 10. The door and knife member 16 is closed and the food stuff thereby retained until ready for use. Upon raising of the member 16, the food stuff stick F is urged by the spring means 10 leftwardly as viewed in FIGS. 1 and 2, so that an end of the food stuff stick F moves through the opening 12 and into engagement with the arms 22, 24 of the spring member 20 and is thereby stopped. The door and knife member 16 is then manually moved downwardly, as viewed in FIG. 3, so that the cam means 30, 32 of the member 16 engage the arm means 22, 24 of the spring means 20 as a cutting edge 34 of the member 16 is cutting through the food stuff stick F. Upon severing a pat of the stick F, the stick falls downwardly and is easily removed inasmuch as the blocking arms 22, 24 are moved to an out of the way position. Upon raising of the member 16, the arm means 22, 24 snap back into a stopping position and the spring 10 urges the carrier 8 and thereby the food stuff stick F outwardly another increment to ready another exposed portion of the stick F for slicing.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. A holder and cutter assembly for food stuffs in stick form, said assembly comprising a chamber for receiving a food stuff in stick form, a carrier disposed in said chamber and adapted to move lengthwise of said chamber in abutting relationship with said food stuff, means for biasing said carrier toward an opening in said chamber, stop means disposed outside said chamber proximate to said opening and in alignment with said chamber, said stop means being adapted to permit a portion of said food stuff stick to be exposed outside said chamber in response to said biasing means, and cutter means disposed adjacent to said opening and operable to cuttingly engage said exposed portion of said food stuff stick to sever said exposed portion from the remainder of said food stuff stick, said stop means being adapted to release said severed portion and move to a position removed from said severed portion, and wherein:

said assembly includes bracket means disposed adjacent to said opening, said bracket means slidably retaining said cutter means;

said stop means comprises wire spring means mounted on said housing, and said bracket means includes means for receiving said wire spring means and facilitating movement of said wire spring means in said slot means; and said cutter means has cam surfaces in engagement with said wire spring means to cause said wire spring means to move widthwise of said opening and outwardly therefrom in said slot means to disengage from said food stuff stick.

2. The invention according to claim 1 in which said means for biasing said carrier comprises spring means disposed in said housing between an end of said housing and said carrier.

3. The invention according to claim 1 in which said cutter member is provided with grip means for manual manipulation thereof.

4. The invention according to claim 1 in which said cutter means is provided at one end thereof with a cutting edge and with said cam surfaces.

5. The invention according to claim 1 in which cutting movement of said cutter means causes said cutter means to engage said stop means to remove said stop means from a stop position.

* * * * *